United States Patent [19]

Pohlman

[11] Patent Number: 4,803,755

[45] Date of Patent: Feb. 14, 1989

[54] INSULATING PAD FOR AUTOMOBILE DOOR HANDLE

[76] Inventor: Nancy L. Pohlman, 21 E. Dawn Dr., Tempe, Ariz. 85284

[21] Appl. No.: 148,299

[22] Filed: Jan. 25, 1988

[51] Int. Cl.[4] ..... B65D 23/10

[52] U.S. Cl. ..... 16/116 R; 16/124; 150/52 L; 428/40

[58] Field of Search ..... 16/116 A, 116 R, 124, 16/1 R, 111 R, DIG. 12; 49/460; 150/52 K, 52 L; 296/37.5, 153; 74/558.5

[56] References Cited

U.S. PATENT DOCUMENTS

| | | | |
|---|---|---|---|
| 1,633,988 | 2/1927 | Jones | 150/52 L |
| 1,668,710 | 10/1927 | Herdman et al. | 178/46 |
| 1,830,383 | 11/1931 | Bos | 150/52 L |
| 2,753,911 | 3/1957 | Haslett | 150/52 L |
| 2,997,089 | 8/1961 | Amdur et al. | 150/52 L |
| 3,343,578 | 7/1967 | Rubin | 150/52 L |
| 4,268,567 | 5/1981 | Harmony | 428/40 |
| 4,358,489 | 11/1982 | Green | 428/40 |

*Primary Examiner*—Nicholas P. Godici
*Assistant Examiner*—Edward A. Brown
*Attorney, Agent, or Firm*—Cahill, Sutton & Thomas

[57] ABSTRACT

A thermal insulating pad for lining an automobile handle includes a layer of thermal insulating and cushioning material such as cross-linked polyethylene foam which is secured to the inner surface of the door handle by means of a layer of adhesive material. The pad, which is not visible from the front of the handle, prevents the handle from burning or chilling the fingertips of a user.

6 Claims, 1 Drawing Sheet

INSULATING PAD FOR AUTOMOBILE DOOR HANDLE

BACKGROUND OF THE INVENTION

1. Field of the Invention

This invention relates in general to automotive accessories, and more particularly, to a protective, thermal insulating pad for lining an automobile door handle.

2. Description of the Prior Art

It is generally well known that the metal exterior of an automotive vehicle becomes extremely hot when the vehicle is left out in intense sunlight for long periods of time. In particular, the heat build-up in the metal door handles of the vehicle can become great enough to burn the fingertips of an individual attempting to enter the vehicle. Similarly, in cold climates, the door handles become extremely frigid and produce a chill when touched.

To the best of my knowledge, there have been no prior art attempts to solve the problems of high thermal conductivity in automobile door handles. The most pertinent prior art of which I am aware is disclosed in U.S. Pat. Nos. 1,633,988, to Jones; 1,668,710, to Herdman et al; 1,830,383, to Bos; 2,753,911, to Haslett; 2,997,089, to Amdur et al; and 3,343,578 to Rubin; all of which disclose protective and/or decorative covers for door knobs or automobile handles.

The primary purpose of most of these covers is to protect the door knobs or handles from greasy fingerprints, dents or other marks, or to prevent the knobs or handles from damaging walls or other surfaces with which they may come in contact when swung open. Secondary purposes of some of the covers are to provide a non-slip surface to facilitate grasping and turning a door knob with wet or slippery hands (Herdman et al), or to protect individuals touching the knobs from shocks due to static electricity (Haslett). Most of the prior art covers are made from cloth, rubber, or other materials which inherently possess some thermal insulating ability and which would therefore slightly diminish the overall thermal conductivity of an automotive door handle. However, none of the prior art covers would be ideal for this purpose since they were not designed with the specific intention of thermally insulating door handles. Furthermore, none of the prior art covers was designed to fit the standard type of handle which is found on modern automobiles. Only the Bos and Jones patents are directed towards covers which are specifically intended for use on automobile handles, and in both cases, the covers were designed to fit over the outwardly projecting, T-shaped, twist-turn type handles which were commonly found on early model automobiles. Since this type of handle was manipulated by grasping the outwardly facing portion of the handle, the covers were designed primarily to protect the outer surface of the handle, and thus would not be effective for use with today's recessed, rectangular door handles which are manipulated by grasping the underside, or inner surface, of the handle, and pivoting upwardly.

Therefore, a need exists for a new and useful insulating pad for lining the inner surface of a modern automobile door handle.

SUMMARY OF THE INVENTION

In accordance with the present invention, a new and useful insulating pad is disclosed for preventing the inner surface of automobile door handle from becoming excessively hot or cold.

The insulating pad comprises a strip of thermal insulating material which is sized and otherwise configured to substantially match the shape and dimensions of the inner surface of a conventional automobile door handle. A layer of adhesive material is bonded to or laminated with the insulating material for securing the pad to the inner surface of the door handle in such a way that the pad is not visible from the outside of the automobile.

The insulating material used in the pad is preferably a foam material. One particular foam material which has been found to be effective is a chemically cross-linked polyethylene foam which is manufactured under the trade name "Minicel" by Foamade Industries of Auburn, Mich. 48057. The low thermal conductivity of this material prevents the handle from becoming excessively hot or cold to the touch when the temperature of an unprotected handle would be intolerable. In addition, the material has a spongy, cushioning effect which makes the door handle more comfortable to manipulate. This latter quality makes the pad especially useful for individuals who find it painful to open the door due to arthritis or other types of discomfort in the joints or muscles.

Therefore, it is an object of this invention to provide a new and useful insulating pad for preventing the inner surface of an automobile handle from becoming excessively hot or cold.

Another object of the invention is to provide an automobile door handle with a protective insulating pad which can not be seen from the exterior of the automobile.

Still another object of the invention is to provide an automobile door handle with a protective insulating pad comprising a layer of foam and a layer of adhesive.

Yet another object of the invention is to provide an insulating pad which is specifically sized and otherwise configured to fit a modern recessed, rectangular, pivotable automotive door handle, and which has cushioning effect to make manipulation of the handle easier and more comfortable for individuals with joint and muscle pain.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
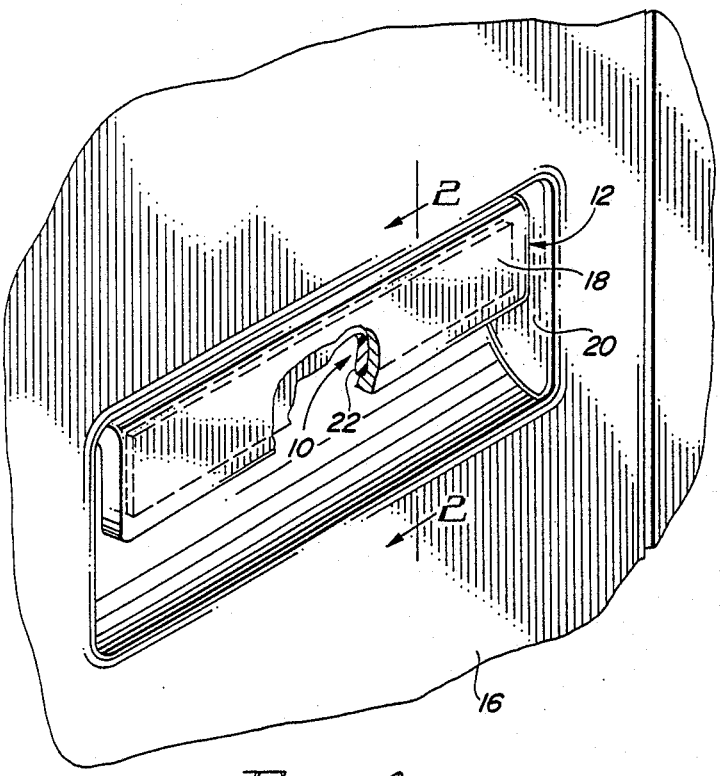
FIG. 1 is a perspective view of an automobile door handle with a portion broken away to show part of the insulating pad of the present invention.
Figure 2:
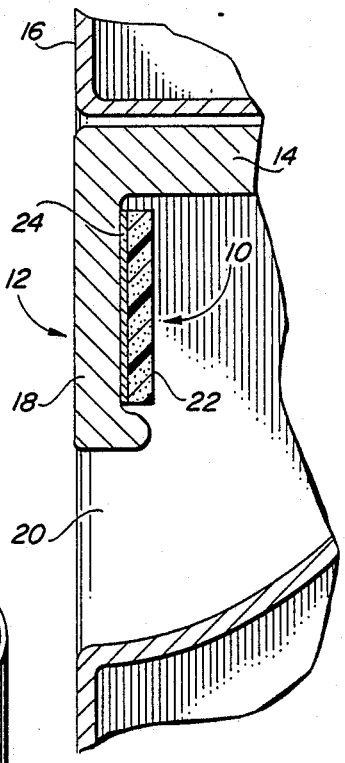
FIG. 2 is a sectional view taken through line 2—2 of FIG. 1.
Figure 3:
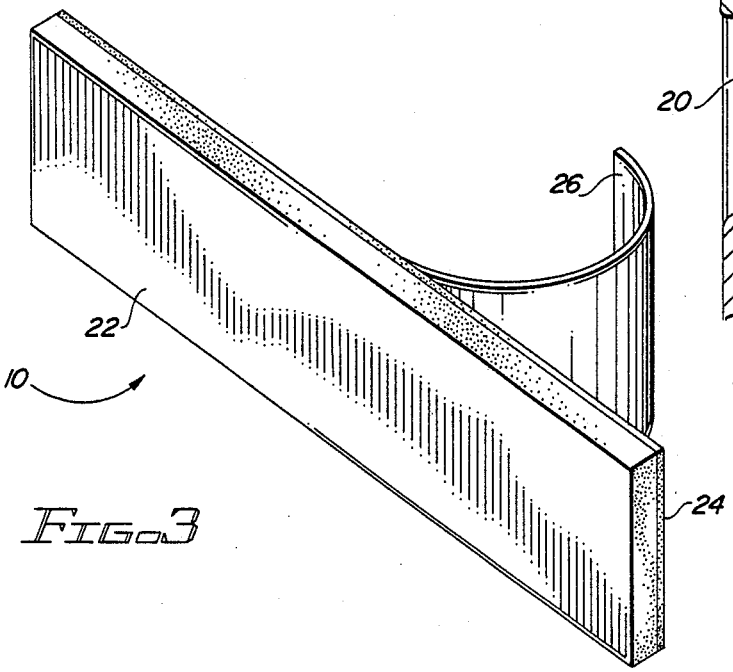
FIG. 3 is a perspective view of the insulating pad of the present invention prior to being mounted on an automobile door handle.

In accordance with the present invention, FIGS. 1 and 2 show the insulating pad of the present invention, indicated in its entirety by the numeral 10, mounted on the inner surface, or underside, of a conventional automobile handle 12. As is generally well known, the handle 12, which is made from metal, is L-shaped in cross-section, with a pivot arm 14 which extends outwardly from the automobile door 16, and a rectangular gripping member 18 which depends from the outer end of the pivot arm 14. A recess 20 is formed in the automobile door 16 below the handle 12 to enable a passenger to reach behind the gripping member 18. To open the door 16 using the handle 12, an automobile passenger simply curls his or her fingers around the bottom edge of the rectangular gripping member 18 and presses outwardly against the inner surface of the handle with his or her fingertips, pivoting the handle 12 upwardly and causing a release mechanism (not shown) inside the door to be actuated.

The insulating pad 10 comprises a strip of thermal insulating material 22 which is sized and otherwise configured to substantially match the shape and dimensions of the inner surface of the gripping member 18. The thermal insulating material 22 is preferably a spongy foam material which has a cushioning as well as an insulating effect. One particular foam material which has been found to be effective is a chemically cross-linked polyethylene foam which is manufactured under the trade name "Minicel" by Foamade Industries of Auburn, Michigan. This material, which has a maximum operating temperature of 180° F. and a minimum operating temperature of −110+ F., has sufficiently low thermal conductivity to prevent an individual opening the door 16 from burning or chilling his or her fingers, even when the outer surface of the door gripping member 18 has become excessively hot or cold. In addition, the cushioning effect of the material is sufficient to reduce the discomfort experienced by an arthritic or other individual experiencing joint or muscle pain when manipulating the handle.

The pad 10 is secured to the inner surface of the door handle 12 by means of a layer of adhesive material 24 such as pressure-sensitive adhesive tape which is bonded to or laminated with the insulating material 22. Preferably, before mounting on the door handle 12, the adhesive material 24 is covered with a peel-off strip 26 of protective material which prevents dust and the like from accumulating on the adhesive material 24. The peel-off strip 26 is removed at the time of mounting to expose the adhesive material 24.

The pad 10 is adapted for mounting solely on the inner surface of the door handle 12, and therefore can not be seen from the outside. This eliminates the need for any decorative features such as coloring or the like which would be necessary on any type of cover mounted on the exterior of a door handle.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A thermally non-conductive automobile door handle assembly, said assembly comprising:

(a) an automobile door;

(b) a metal door handle, said door handle being generally L-shaped in cross-section and including a pivot arm extending outwardly from said automobile door and a rectangular gripping member depending perpendicularly from said pivot arm;

(c) a recess formed in said door beneath said handle; and (d) an insulating pad secured to the inner surface of said rectangular gripping member of said handle, said pad being obscured from view by said rectangular gripping member and including, I. a strip of thermal insulating and cushioning material sized and otherwise configured to match the shape and dimensions of the inner surface of the door handle, and II. fastening means joined to said insulating material for securing the strip of thermal insulating and cushioning material to the inner surface of the door handle.

2. The door handle assembly of claim 1, in which said thermal insulating and cushioning material is a foam material.

3. The door handle assembly of claim 2, in which said foam material is cross-linked polyethylene foam.

4. The door handle assembly of claim 3, in which said fastening means comprises an adhesive material.

5. The insulating door handle assembly of claim 4, in which said adhesive material comprises a pressure sensitive adhesive.

6. The insulating door handle assembly of pad of claim 4 further comprising a peel-off strip of protective material for preventing dust from accumulating on said pressure sensitive adhesive and for removal from said adhesive prior to attachment to said door handle.

* * * * *